US009096333B2

(12) United States Patent
Honda

(10) Patent No.: US 9,096,333 B2
(45) Date of Patent: Aug. 4, 2015

(54) ROTARY-TYPE BAG FILLING AND PACKAGING MACHINE

(71) Applicant: Toyo Jidoki Co., Ltd., Minato-ku, Tokyo (JP)

(72) Inventor: Yasuyuki Honda, Iwakuni (JP)

(73) Assignee: TOYO JIDOKI CO., LTD., Tokyo (JP)

( * ) Notice: Subject to any disclaimer, the term of this patent is extended or adjusted under 35 U.S.C. 154(b) by 493 days.

(21) Appl. No.: 13/677,006

(22) Filed: Nov. 14, 2012

(65) Prior Publication Data

US 2013/0125508 A1 May 23, 2013

(30) Foreign Application Priority Data

Nov. 17, 2011 (JP) ..... 2011-251173

(51) Int. Cl.

| | |
|---|---|
| ***B65B 1/04*** | (2006.01) |
| ***B65B 31/04*** | (2006.01) |
| ***B65B 39/12*** | (2006.01) |
| ***B65B 43/50*** | (2006.01) |
| ***B65B 3/04*** | (2006.01) |

(52) U.S. Cl.

CPC ... *B65B 1/04* (2013.01); *B65B 3/04* (2013.01); *B65B 31/042* (2013.01); *B65B 39/12* (2013.01); *B65B 43/50* (2013.01)

(58) Field of Classification Search

CPC ..... B65B 1/04; B65B 31/042; B65B 3/04; B65B 39/12; B65B 43/50; B65B 1/06; B65B 7/02; B65B 7/06; B65B 31/041; B65B 31/044; B65B 31/048; B65B 31/06; B65B 35/12; B65B 37/16; B65B 39/007; B65B 39/02; B65B 43/28; B65B 43/30; B65B 43/465; B65B 43/60; B65B 2220/14

USPC ..... 53/55, 512, 570, 239, 250, 253, 284.7

See application file for complete search history.

(56) References Cited

U.S. PATENT DOCUMENTS

| | | | | |
|---|---|---|---|---|
| 5,024,717 | A * | 6/1991 | Winter | 156/354 |
| 6,199,601 | B1 * | 3/2001 | Laudenberg | 141/48 |
| 7,954,307 | B2 * | 6/2011 | Paunesku et al. | 53/459 |
| 2005/0188655 | A1 * | 9/2005 | Thatenhorst | 53/415 |

FOREIGN PATENT DOCUMENTS

| | | | |
|---|---|---|---|
| JP | H2-27235 | A | 1/1990 |
| JP | 2884064 | B | 4/1999 |
| JP | 3742042 | B | 2/2006 |
| JP | 2007-126208 | A | 5/2007 |
| JP | 2008-308204 | A | 12/2008 |

* cited by examiner

*Primary Examiner* — Thanh Truong
*Assistant Examiner* — Thomas M Wittenschlaeger
(74) *Attorney, Agent, or Firm* — DLA Piper LLP (US)

(57) ABSTRACT

A rotary-type bag filling and packaging machine including a synchronized table (19) provided above a rotary table (16), which has a plurality of gripper pairs (3), and gas injection nozzles (28), which are provided on the synchronized table (19) so as to correspond to the gripper pairs (3). The synchronized table (19) rotates co-axially with the rotary table (16) in an intermittent manner by a first servo motor (21), which is independent from the drive source of the rotary table (16). A second servo motor (25) which raises and lowers the gas injection nozzle (28) is provided on the synchronized table (19) in conjunction with each gas injection nozzle (28).

6 Claims, 4 Drawing Sheets

ROTARY-TYPE BAG FILLING AND PACKAGING MACHINE

BACKGROUND OF THE INVENTION

1. Field of the Invention

The present invention relates to a rotary-type bag filling and packaging machine and more particularly to an improvement in a rotary-type bag filling and packaging machine.

2. Description of the Related Art

In a typical rotary-type bag filling and packaging machine, a plurality of pairs of grippers for clamping two side edge portions of a supplied bag and thus holding the bag in a suspended position are provided at regular intervals on a periphery of a rotary table that rotates continuously or intermittently in one direction on a horizontal plane, and these gripper pairs travel in a rotational manner in one direction by the rotary table, either continuously or intermittently, so that various packaging operations, such as opening the mouths of bags, filling the bags with the material to be packaged, and sealing the mouths of the bags, are performed in a sequential manner to the bags held by the grippers.

The above-described various packaging operations are performed by packaging apparatuses, and one type thereof is a synchronized-type packaging apparatus. This synchronized-type packaging apparatus includes a plurality of packaging members which are provided in conjunction with each one of pairs of grippers and raised and lowered at a predetermined timing while traveling in a rotational manner in synchronism with the gripper pairs.

For example, a rotary-type bag filling and packaging machine described in Japanese Patent No. 2884064 includes a synchronized-type packaging apparatus that is provided with a plurality of filling funnels as the packaging members. The filling funnels are provided in conjunction with gripper pairs and raised and lowered at a predetermined timing while traveling in a rotational manner in concert with the gripper pairs.

The synchronized-type packaging apparatus in a rotary-type bag filling and packaging machine described in Japanese Patent No. 3742042 includes a plurality of filling funnels as its packaging members, and another synchronized-type packaging apparatus in this bag filling and packaging machine includes a plurality of gas injection nozzles as its packaging members. The filling funnels are provided in conjunction with gripper pairs, and gas filling nozzles are provided in the filling funnels; and the filling funnels and the gas filling nozzles are raised and lowered at a predetermined timing while traveling in a rotational manner in concert with the gripper pairs.

The synchronized-type packaging apparatus in a rotary-type bag filling and packaging machine described in Japanese Patent Application Laid-Open (Kokai) No. 2008-308204 includes a plurality of gas injection nozzles or liquid filling nozzles as the packaging members. The nozzles are provided in conjunction with gripper pairs and are raised and lowered at a predetermined timing while traveling in a rotational manner in concert with the gripper pairs.

The synchronized-type packaging apparatus of a rotary-type bag filling and packaging machine described in Japanese Patent Application Laid-Open (Kokai) No. 2007-126208 includes a plurality of pairs of aperture guide members (also serving as gas injection nozzles) as the packaging members. The aperture guide member pairs are provided in conjunction with a pair of grippers, and they are raised and lowered, as well as opened and closed, at a predetermined timing while traveling in a rotational manner in concert with the gripper pairs.

Though Japanese Patent Application Publication (Kokoku) No. H2-27235 is not related to a rotary-type bag filling and packaging machine, it describes a container capping apparatus; and in this container capping apparatus, a plurality of plug-holding mechanisms are raised and lowered at a predetermined timing while traveling in a rotational manner in concert with container-holding mechanisms.

In the above-described rotary-type bag filling and packaging machines, there is a case that a single-type packaged product (of the same bag size, the same bag shape, and the same material to be packaged, for instance) is manufactured, and there is another case in which it is desired that they produce two or more different types of packaged products as occasions demand. In the latter case, when the packaged product to be manufactured is changed, such a situation would occur that both location of installation and raising/lowering operations of the packaging members be changed so that they match the specifications suited to the packaged product to be manufactured.

This situation will be explained below referring to the bags of FIGS. 4A and 4B (in which the packaging members of a synchronized-type packaging apparatus are liquid filling nozzles).

In FIG. 4A, the bag to be filled is an ordinary quadrangular flat bag 1 (called "ordinary flat bag" or "flat bag" hereinafter), while in FIG. 4B the bag is an irregularly shaped flat bag 2 that has a spout 2*a* in the top corner section (hereinafter called "irregularly shaped bag"). The bag width and the bag length (or height) of the two bags are identical. For these examples, the location of installation and the height for which liquid filling nozzles 4 are raised and lowered are assumed to meet the specifications for each bag.

For the bag shown in FIG. 4A, the location of installation of the liquid filling nozzle 4 is set to the location of the center Mc (shown by a dashed line) in the bag width direction of the mouth of the flat bag 1 that is held by a pair of grippers 3. This central location Mc of the bag mouth coincides with the location of the center Gc of the gripper pair (which is the same as the location of the center of the flat bag 1 in the bag width direction). In addition, the raising/lowering range H of the liquid filling nozzle 4 is set so that it is between the ascended upper end position Hu and the descended lower end position Hd.

For the bag shown in FIG. 4B, though the location of installation of the liquid filling nozzle 4 is set to the location of the center Mc in the bag width direction of the mouth of the irregularly shaped bag 2 held by a pair of grippers 3, this central location Mc is offset from the location of the center Gc of the gripper pair (which is the same as the location of the center of the irregularly shaped bag 2 in the bag width direction) by a distance W in the circumferential direction of the rotary table on which the grippers 3 are provided or in the width direction of the bag. In addition, in the case of the irregularly shaped bag 2 of FIG. 4B, the location where this bag is clamped by the gripper pair 3 is slightly lower than that where the flat bag 1 of FIG. 4A is clamped by the grippers, and therefore, the ascended upper end position Hu of the liquid filling nozzle 4 is set higher than the ascended upper end position Hu for the flat bag 1 and, furthermore, the descended lower end position Hd of the liquid filling nozzle 4 is set to be closer to the bottom of the irregularly shaped bag 2 in order to prevent foaming and splashing that would occur during the filling process, and thus the raising/lowering range H differs from the raising/lowering range H in the case of the flat bag 1 of FIG. 4A.

When in the above-described rotary-type bag filling and packaging machines flat bags 1 shown in FIG. 4A have been worked and filled with contents, and the bags to be processed are to be changed to irregularly shaped bags 2 shown in FIG. 4B, then it is preferable to change the location of installation and the raising/lowering range of the liquid filling nozzle 4 used as the packaging member to those illustrated in FIG. 4B.

However, since the liquid filling nozzles 4 (corresponding in number to the gripper pairs 3) are provided in a plurality of numbers in the filling and packaging machine, the operation of changing the location of the installation of all the liquid filling nozzles 4 in the circumferential direction is extremely complicated and burdensome, causing unavoidable productivity drop. This is a problem not only for the liquid filling nozzles 4 illustrated in FIGS. 4A and 4B but also for all packaging members of synchronized-type packaging apparatuses including, for example, gas injection nozzles, filling funnels, and the like.

In addition, any packaging members used in the conventional synchronized-type packaging apparatuses are constructed so that they are raised and lowered by a cam mechanism that functions as a drive source for the packaging members, and this cam mechanism is integrally incorporated in the body of the packaging machine (of the above-described four Japanese patent references). For this reason, changing the manner of the raising/lowering actions of the packaging members (which, in addition to the raising/lowering range, also includes raising/lowering timing, raising/lowering speed, raising/lowering frequency per filling, etc.) is substantially difficult. Even if the drive sources used to raise/lower the packaging members are replaced with air cylinders (as disclosed in Japanese Patent Application Publication (Kokoku) No. H2-27235), it is still quite difficult to change the raising/lowering range and raising/lowering speed.

BRIEF SUMMARY OF THE INVENTION

The present invention is devised by taking into account the above-described problems associated with the conventional rotary-type bag filling and packaging machines that include synchronized-type packaging apparatuses, and it is an object of the present invention to provide a rotary-type bag filling and packaging machine in which raising/lowering operations and location of installation of the packaging members can be easily matched to specifications suited for the packaged product to be manufactured.

The above object is accomplished by a unique structure of the present invention for a rotary-type bag filling and packaging machine, and, more particularly, by the improvements of the present invention in a rotary-type bag filling and packaging machine equipped with synchronized-type packaging apparatuses, wherein

- a plurality of pairs of grippers each for clamping two side edge portions of a supplied bag and for holding the bag in a suspended position are provided at regular intervals on a periphery of a rotary table that rotates in one direction on a horizontal plane,
- the gripper pairs are caused to travel in a rotational manner in one direction, and
- various packaging operations, such as opening the mouth of the bag, filling the bag with material to be packaged, and sealing the mouth of the bag, etc., are performed in a sequential manner on the bag held by the gripper pairs; and in the present invention the rotary-type bag filling and packaging machine further comprises;

- a synchronized table which is provided at a location above the rotary table co-axially with the rotary table and around which a plurality of packaging members of the synchronized-type packaging apparatuses are disposed at regular intervals;
- a first servo motor for rotating the synchronized table;
- a second servo motor which is provided on the synchronized table in conjunction with each one of the packaging members for raising or lowering the packaging members; and
- a controller which, by controlling the drive source of the rotary table and the driving of the first and second servo motors, causes the synchronized table to rotate in synchronism with the rotary table and, at the same time, to raise or lower the packaging members at a predetermined timing.

In the above-described rotary-type bag filling and packaging machine of the present invention, it is preferable that it take the configurations below:

(1) A sensor can be provided that detects the relative positional relationship between a fixed location on the rotary table and a fixed location on the synchronized table in their rotational direction, and the controller adjusts the relative positional relationship between the two fixed locations in the rotational direction based on the detection signal obtained from the sensor.

(2) A sensor can be provided that detects the relative positional relationship between a fixed location on the rotary table and a fixed location on the synchronized table in their rotational direction, and data on the type of the packaged product and the corresponding relative positional relationship between the two fixed locations in the rotational direction is inputted into the controller in advance. Thus, using the controller, it is possible to adjust the relative positional relationship between the two fixed locations in the rotational direction of the tables based on the detection signal obtained from the sensor and on the data on the type of the packaged product.

(3) The packaging members are gas injection nozzles or liquid filling nozzles.

(4) The rotary table rotates continuously or intermittently.

As seen from the above, according to the present invention, the driving of the first and second servo motors is controlled by the controller; and as a result, it is possible to move all the packaging members of the synchronized-type packaging apparatuses in a rotational manner in synchronism (in sync) with the gripper pairs, and it is also possible to freely set the location of installation of the packaging members in the circumferential direction of the tables relative to the gripper pairs and the specifications of the raising/lowering operations of the packaging members in accordance with the type of the packaged products (various bag sizes, bag shapes, materials to be packaged, etc.).

Therefore, in the present invention, if the packaging members of the synchronized-type packaging apparatus are, for instance, liquid filling nozzles, foaming and splashing during filling operation can be prevented better than the case in which the specifications of the raising/lowering operations are not changeable; and if the packaging members are, for instance, gas filling nozzles, then it is possible to improve the rates of gas exchange or degassing, and a packaged product that has a high degree of perfection can be obtained.

In addition, the locations of installation of all the packaging members of the synchronized-type packaging apparatuses in the circumferential direction of the tables relative to the gripper pairs can be easily changed in the present invention.

Accordingly, when, for example, the irregularly shaped bag 2 illustrated in FIG. 4B is processed and locations of the center Mc of the mouth of bag in the bag width direction and of the central location Gc between the two grippers are offset from each other, the locations of installation of all the liquid filling nozzles or gas filling nozzles, etc. of the synchronized-type packaging apparatus can be brought to correspond to, for instance, the location of the center Mc without suffering a productivity loss.

DETAILED DESCRIPTION OF THE INVENTION

Below, a rotary-type bag filling and packaging machine according to the present invention will be described with reference to FIGS. 1 through 4B.

Figure 1:
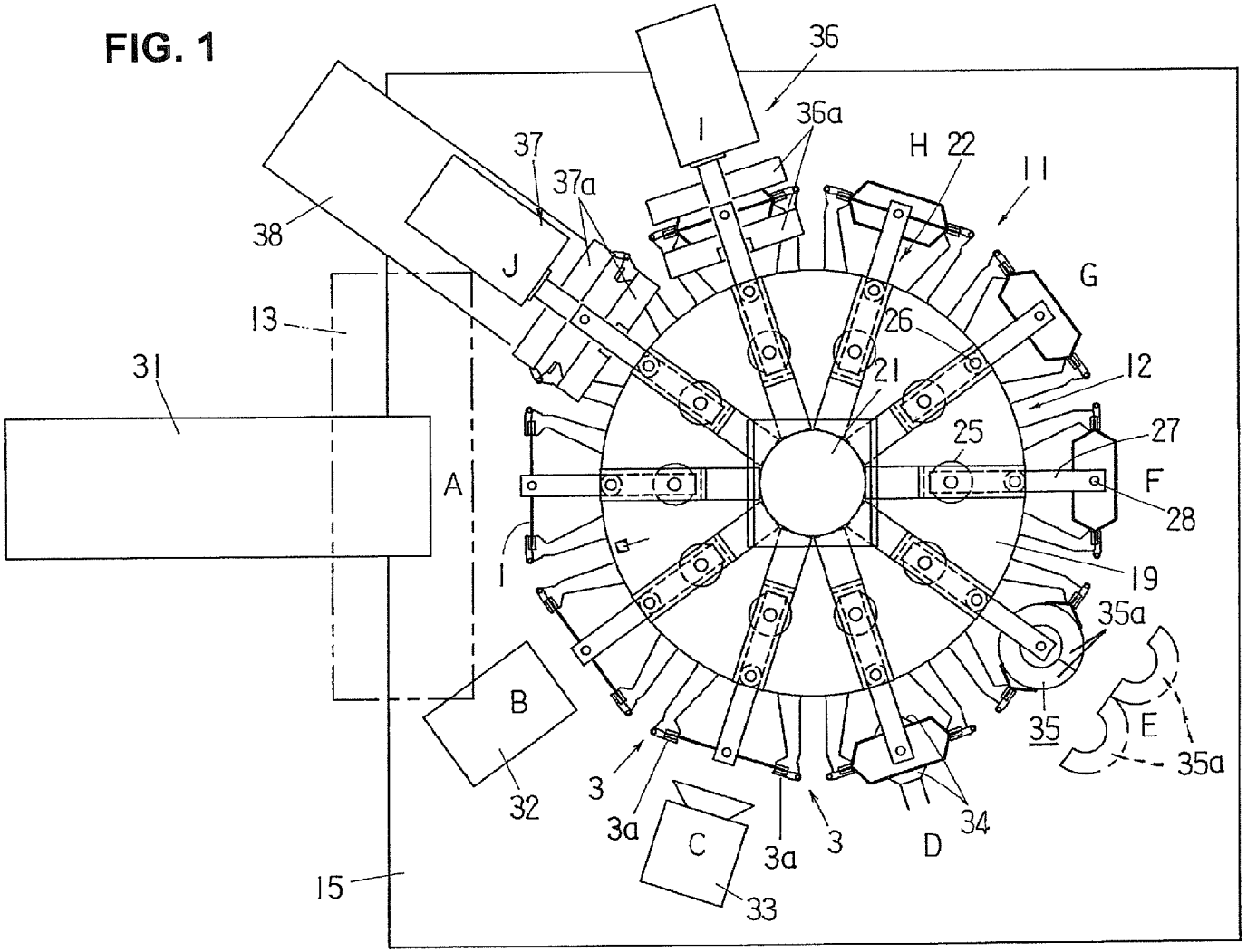
FIG. 1 is a top view of a rotary-type bag filling and packaging machine according to the present invention.
Figure 2:
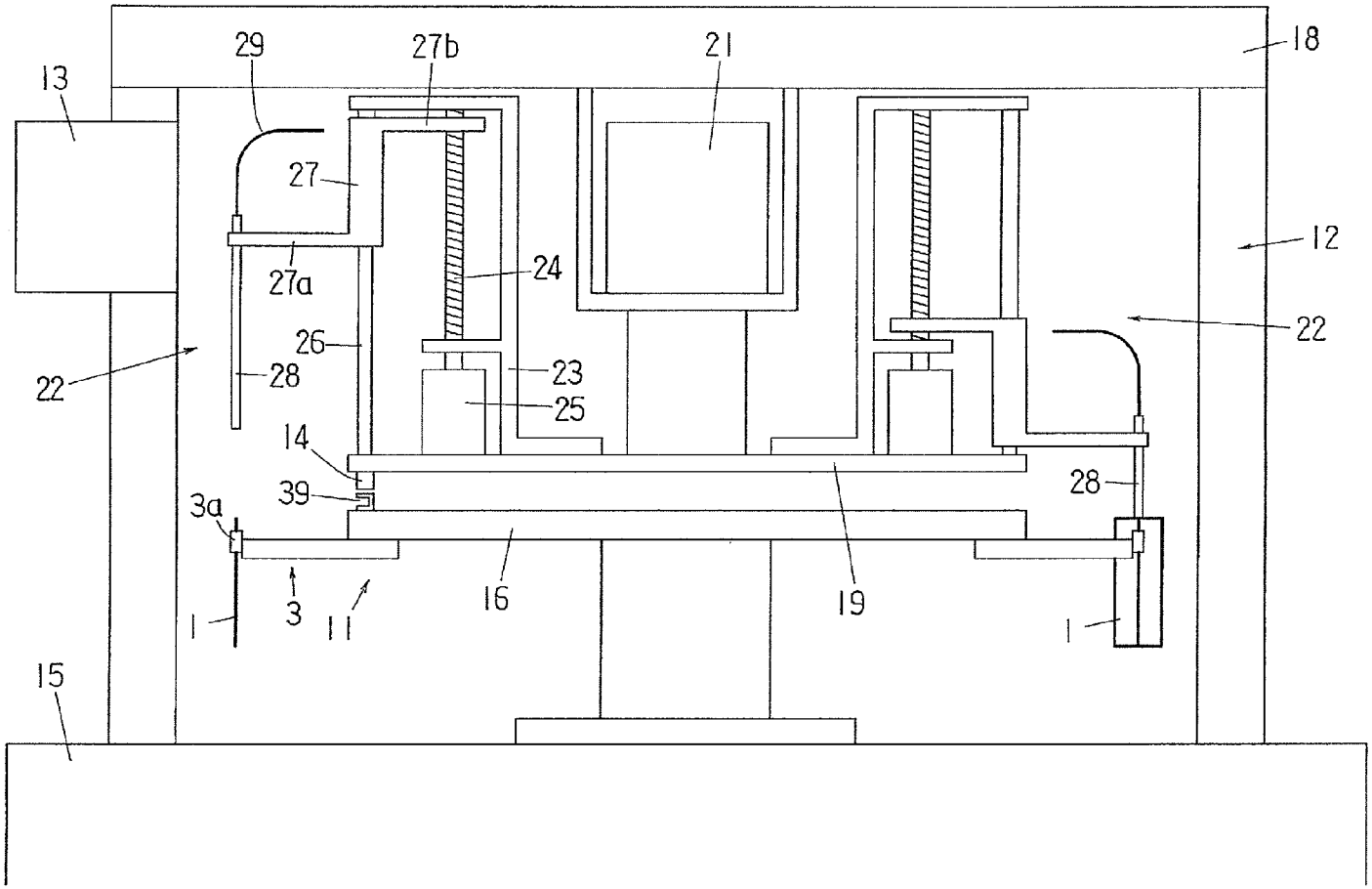
FIG. 2 is a cross-sectional side view thereof.
Figure 3:
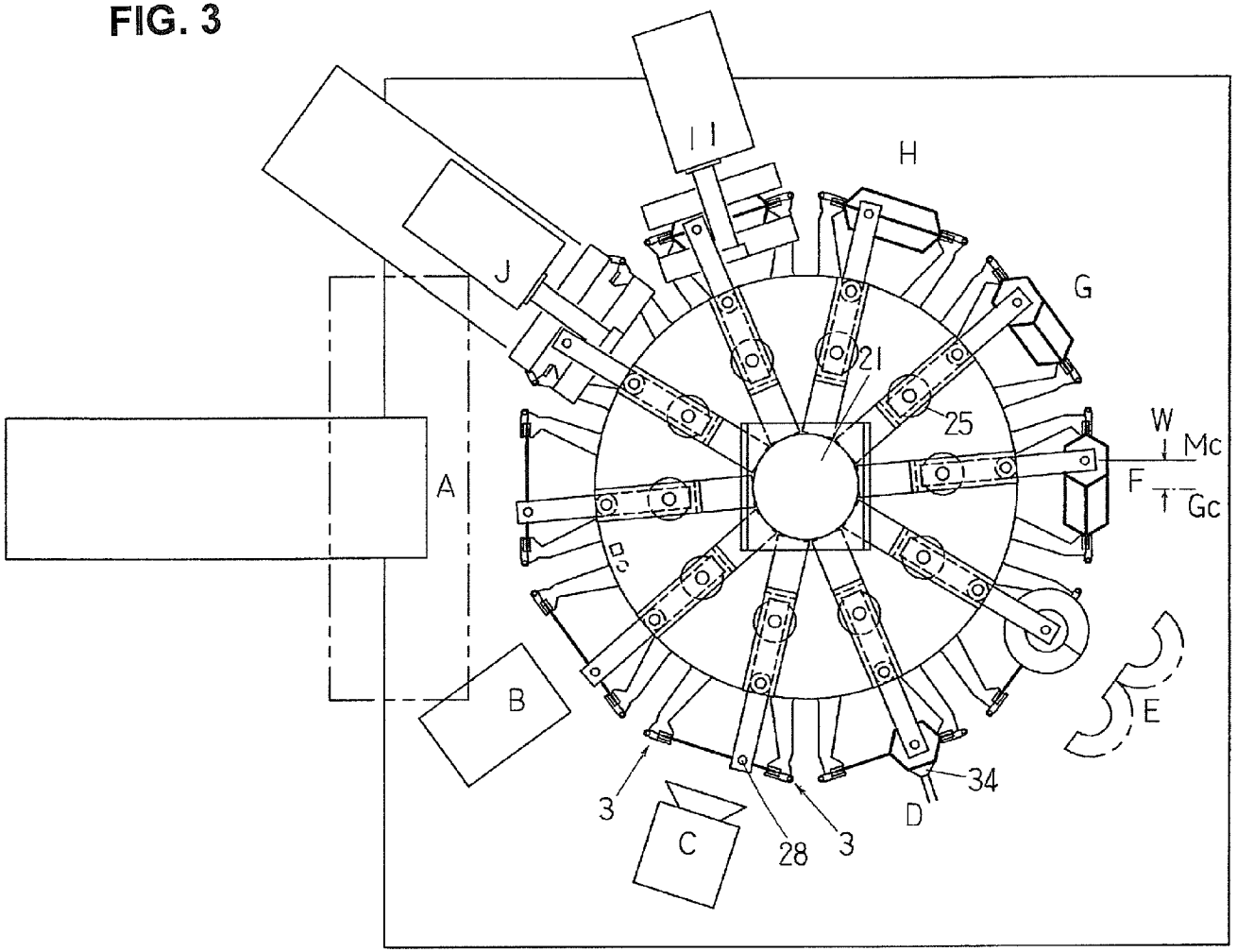
FIG. 3 is a top view of the rotary-type bag filling and packaging machine according the present invention, wherein the position of the synchronized table is offset from the rotary table in the circumferential direction.

The rotary-type bag filling and packaging machine illustrated in FIGS. 1 and 2 includes an intermittent rotation type rotary-type bag transporting apparatus 11, a plurality of packaging apparatuses including a synchronized-type packaging apparatus 12 (called a "synchronized-type gas exchange apparatus 12" below), a controller 13, a position sensor 14, and the like.

The rotary-type bag transporting apparatus 11 is installed on a pedestal 15, and it includes a rotary table 16 which is intermittently rotated in one direction (counterclockwise in FIG. 1) in the horizontal plane by a drive source (not shown) and ten (10) groups of gripper pairs 3 disposed on a periphery of the rotary table 16 at regular intervals. With the intermittent rotation of the rotary table 16, the gripper pairs 3 intermittently travel (intermittently rotated) at regular angular intervals along a circular travel path in the horizontal plane in step. During the intermittent travel, the gripping portions 3*a* and 3*a* of each of the gripper pairs 3 are opened and closed at a predetermined timing in a generally known manner, and, at the same time, the gap between the gripping portions 3*a* and 3*a* is widened or narrowed.

The synchronized-type gas exchange apparatus 12 comprises a frame 18 which is installed on the pedestal 15, a synchronized table 19 which is provided so as to be horizontally rotatable on the frame 18, a first servo motor 21 which rotates the synchronized table 19, ten (10) gas injection units 22 which are installed on the periphery of the synchronized table 19 at regular intervals, etc. Each gas injection unit 22 is comprised of, among others, a support stand 23 which is installed on the synchronized table 19, a threaded shaft 24 which is vertically and rotatably provided on the support stand 23, a second servo motor 25 which is installed on the synchronized table 19 and rotates the threaded shaft 24, a slide shaft 26 which is set upright on the synchronized table 19 and has its upper end fixedly secured to the support stand 23, a sliding member 27 through which the slide shaft 26 is provided so that the sliding member 27 can freely slide up and down along the slide shaft 26, and a gas injection nozzle 28 which is fixedly secured to the outwardly protruding strut 27*a* of the sliding member 27. An inwardly protruding strut 27*b* of the sliding member 27 is threadedly engaged with the threaded shaft 24 so that, when the second servo motor 25 is activated and the threaded shaft 24 is rotated axially, the sliding member 27 and the gas injection nozzle 28 are raised or lowered.

The synchronized table 19 has the same axis (a line serving as the center of rotation) as the rotary table 16. The first servo motor 21, which rotates the synchronized table 19, is a drive source independent from the drive source of the rotary table 16. The ten (10) gas injection nozzles 28 are disposed on the periphery of the synchronized table 19 at regular intervals and are rotated in step with the rotation of the synchronized table 19 along a travel path that substantially overlaps with the travel path of the gripper pairs 3 in plan view or when viewed from above. The gas injection nozzles 28 are respectively connected via tubes 29 to a gas supply source and a switching valve (rotary valve), both not shown.

During a single revolution, the rotary table 16 of the rotary-type bag transporting apparatus 11 stops ten (10) times at regular angular intervals, and other packaging apparatuses than the synchronized-type packaging apparatus 12 are disposed at stop positions A-J where the gripper pairs 3 around the rotary table 16 make their stops. More specifically, the other packaging apparatuses includes, as shown in FIG. 1, a conveyer magazine-type bag supply apparatus 31 which is disposed at stop position A, a printer 32 which is disposed at stop position B, a marking inspection apparatus 33 which is disposed at stop position C, an opening device for opening the mouths of the bags which is disposed at stop position D (only a pair of suction cups 34 of the opening device are shown in FIG. 1), a to-be-packaged material (contents) supply apparatus which is disposed at stop position E (only a hopper 35 of the contents supply apparatus is shown), a sealing device 36 including a pair of heating plates 36*a* which is disposed at stop position I, and a packaged product discharge chute 38 and a seal cooling device 37 including a pair of cooling plates 37*a* which are disposed at stop position J.

The hopper 35 of the contents supply apparatus is formed by joining two vertically separated hopper sections 35*a* with a hinge, and it is closed to make a cylindrical configuration as indicated by solid lines and opened as indicated by two-dot chain line. In addition, the hopper 35 reciprocates between an advanced position indicated by the solid lines and a retracted position indicated by the two-dot chain line while being opened; and at the advanced position the hopper 35 is closed into the cylindrical configuration and raised and lowered. With the above-described opening/closing structure and reciprocating motion of the hopper 35, an interference between the hopper 35 and the gas injection nozzle 28 is prevented.

The position sensor 14 is a proximity sensor, and it is installed at a predetermined location on the lower surface of the synchronized table 19. The position sensor 14 detects a detection marker 39 provided on the upper surface of the rotary table 16 and regulates the relative positional relationship between the rotary table 16 and the synchronized table 19.

Figure 4B:
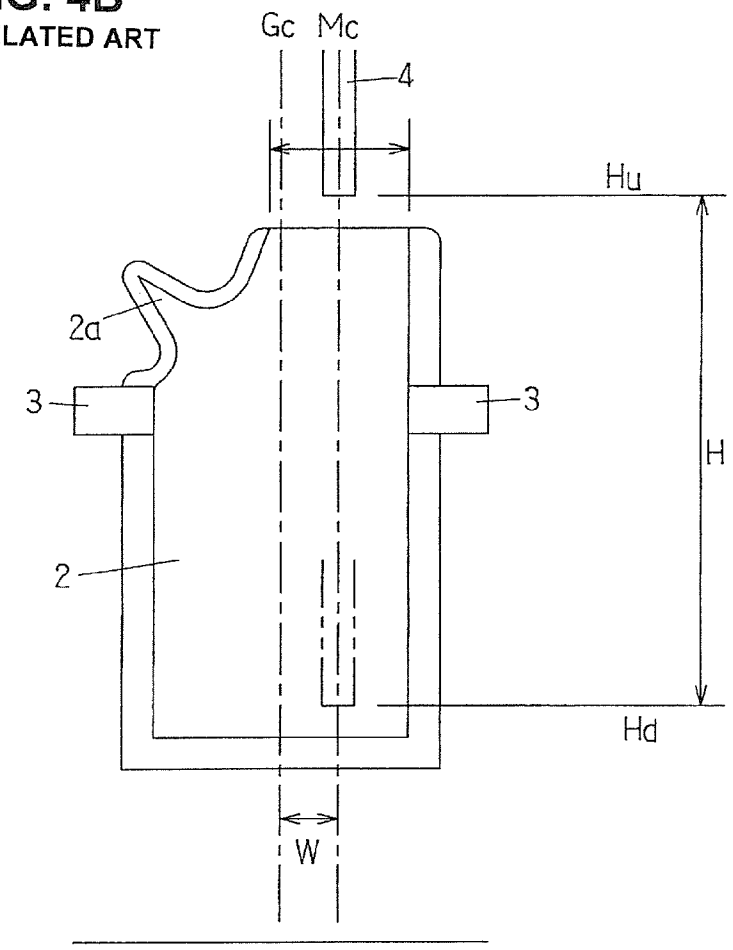
FIG. 4B RELATED ART
FIGS. 4A and 4B illustrate ordinary flat bags (FIG. 4A) and irregularly shaped bags (FIG. 4B) to explain the problems associated with a rotary-type bag filling and packaging machine equipped with a synchronized-type packaging apparatus of conventional type and to explain the operation of the rotary-type bag filling and packaging machine equipped with a synchronized-type packaging apparatus according to the present invention.
Figure 4A:
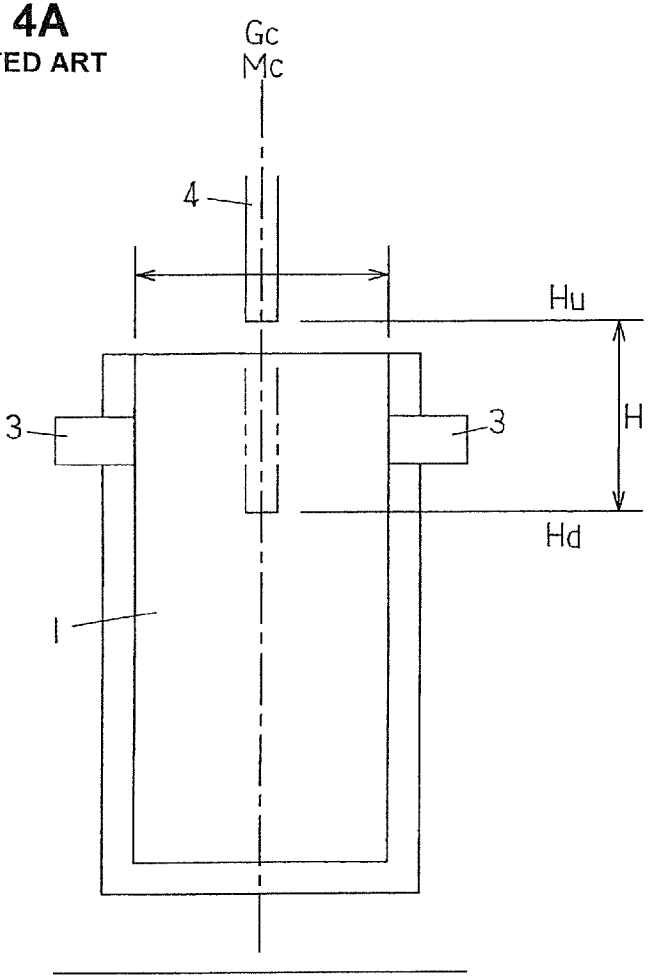
FIG. 4A RELATED ART

The location of installations of the position sensor 14 and the detection marker 39 is determined such that the position sensor 14 detects the detection marker 39 at the moment when the gas injection nozzles 28 in the rotary-type bag filling and packaging machine are positioned directly above the central locations Gc of the gripper pairs 3 (see FIG. 4A). It should be noted that the central location Gc of the gripper pairs 3 is the same as the location of the center Mc of the mouth of an ordinary flat bag 1 in the bag width direction.

When the position sensor 14 detects the detection marker 39 and a corresponding detection signal is as a result sent to the controller 13, the controller 13 determines the offset (more specifically, the presence or absence of an offset, and the magnitude of the offset) between the central position Gc on the rotary table 16 and the location of installation of the gas injection nozzle 28 on the synchronized table 19, in other words, the relative positional relationship between the rotary table 16 and the synchronized table 19.

The rotary table 16 is rotated in an intermittent manner by a drive source (not shown) which is controlled by the controller 13, so that the central location Gc of each pair of grippers 3 always stops at the same position (at the stop positions A-J). Even if the packaged product is changed, the stop positions do not change essentially.

The first servo motor 21, which is likewise controlled by the controller 13, intermittently rotates the synchronized table 19 in synchronism (in sync) with the rotary table 16. Although the relative positional relationship between the rotary table 16 and the synchronized table 19 is maintained basically constant as long as the same packaged product is processed, the relative positional relationship may sometimes be modified if the type of the packaged product (bag size, bag type, and the type of material to be packaged, etc.) is changed. More specifically, as explained with reference to FIGS. 4A and 4B, if the bags processed to be filled with contents are flat bags 1 (FIG. 4A), the relative positional relationship between the rotary table 16 and the synchronized table 19 is configured such that the central location Gc and the location of installation of the gas injection nozzle 28 are precisely superimposed. By contrast, if the bags processed to be filled with contents are irregularly shaped bags 2 (FIG. 4B), the relative positional relationship between the rotary table 16 and the synchronized table 19 is configured such that the central location Gc and the location of installation of the gas injection nozzle 28 are offset from each other by a distance W.

On the other hand, data regarding the relative positional relationships corresponding to several packaged products (including the offset distance between the central location Gc of the gripper pair 3 on the rotary table 16 and the location of installation of the gas injection nozzle 28 on the synchronized table 19) is inputted in the memory means of the controller 13 in advance. The data regarding these relative positional relationships can expressed by the number of pulses that are generated by an encoder directly connected to the shaft of the first servo motor 21 during a time span in which the gas injection nozzle 28 travels, when only the first servo motor 21 is activated, for a predetermined distance from an original position where the rotary table 16 and the synchronized table 19 are stopped and the position sensor 14 detects the detection marker 39. If the bags to be filled with contents are ordinary flat bags 1, the number of pulses is zero; and if the bags are irregularly shaped bags 2, the number of pulses is one that corresponds to the distance W. In the example of FIG. 2, the central location Gc of the gripper pair 3 precisely overlaps with the location of installation of the gas injection nozzle 28 at the or original position when viewed from above.

In addition, the specifications of the raising/lowering operations of the gas injection nozzles 28 (raising/lowering range or distance, raising/lowering timing, raising/lowering speed, raising/lowering frequency per injection, etc.) that correspond to a plurality of packaged products, as well as the timing of start and end of gas injection, etc., are inputted into the memory means of the controller 13 in advance.

The operation of the rotary-type bag filling and packaging machine illustrated in FIGS. 1 and 2, in particular the operation of the rotary table 16 and the synchronized table 19, will be described below.

Prior to the start of packaging or filling process, initial setup for the type of target packaged product is carried out. This is done by operating a control panel (not shown) of the controller 13 (practically, only the type of the packaged product is inputted through the control panel). As a result, the drive source operates to position the rotary table 16 at the original position, and, at the same time, the first servo motor 21 operates to position the synchronized table 19 at the original position based on the detection signal from the position sensor 14. Furthermore, the first servo motor 21 continues to operate and rotates the synchronized table 19 for a predetermined number of pulses that corresponds to the type of the packaged product to be processed.

If the inputted bag shape for the packaged product is the flat bag 1, the predetermined number of pulses corresponding to the type of the packaged product is zero, and there is no rotation of the synchronized table 19 relative to the original position, and the above-described original position serves as the reference position for the intermittent rotation of the synchronized table 19. At such time, the location of installation of the gas injection nozzle 28 overlaps with the central location Gc of the gripper pair 3 in plan view or when viewed from above.

Subsequently, packaging is initiated by operating the control panel of the controller 13. Upon initiation, the rotary table 16 intermittently rotates such that the central location Gc of each pair of grippers 3 always stops in the same position (at stop positions A-J), the synchronized table 19 intermittently rotates in synchronism (in sync) with the rotary table 16; and, during such time, the relative positional relationship with respect to the rotary table 16 is maintained constant. Therefore, the relative positional relationship between the gripper pairs 3 and the corresponding gas injection nozzles 28 is maintained constant. In addition, the operation of the second servo motors 21 causes the gas injection nozzles 28 to be raised or lowered in accordance with the inputted packaged product type.

On the other hand, if the inputted bag shape for the packaged product is the irregularly shaped bag 2, the synchronized table 19 rotates from the original position for the number of pulses corresponding to the distance W illustrated in FIG. 4B and stops. As a result, each gas injection nozzle 28 stops at a position offset from the central location Gc of each pair of grippers 3 by the distance W when viewed from above or in plan view. This position serves as the reference position for the intermittent rotation of the synchronized table 19 (see FIG. 3).

Subsequently, packaging is initiated by operating the control panel of the controller 13. Upon initiation, the rotary table 16 intermittently rotates such that the central location Gc of each pair of grippers 3 always stops in the same position (stop positions A-J), the synchronized table 19 intermittently rotates in synchronism (in sync) with the rotary table 16; and, during such time, its relative positional relationship with respect to the rotary table 16 is maintained constant. Therefore, the relative positional relationship between the gripper pairs 3 and the corresponding gas injection nozzles 28 is maintained constant. In addition, the operation of second servo motors 21 causes the gas injection nozzles 28 to be raised or lowered in accordance with the inputted packaged product type.

Next, the entire packaging process performed by the rotary-type bag filling and packaging machine illustrated in FIGS. 1 and 2 will be described.

First of all, at stop position A, an ordinary flat bag 1 is supplied to a gripper pair 3, which are stationary at this point, by the conveyer magazine type bag supply apparatus 31. Then, at stop position B, the bag surface of the flat bag 1 is imprinted by the printer 32, and, at stop position C, the surface of the bag is subjected to inspection for markings by the marking inspection apparatus 33.

At stop position D, the mouth of the flat bag 1 is opened by the two suction cups 34 of the opening device (while reducing the distance between the two grippers 3), after which the gas injection nozzle 28, which has been in a standby mode in the upper end position (see the upper end position Hu in FIG. 4A), is lowered and inserted into the flat bag 1, reaching the lower end position (see the lower end position Hd in FIG. 4A), and the injection of gas (inactive gas such a nitrogen gas, etc.) from the lower end of the gas injection nozzle 28 is initiated. On the other hand, after opening the mouth of the flat bag 1, the pair of suction cups 34 terminates suction and are separated from the surface of the flat bag 1.

When the gripper pair 3 and the gas injection nozzle 28 are stopped at stop position E, the opened hopper 35 (shown by the two-dot chain line) moves from a retracted position to an advanced position, and it is closed around the gas injection nozzle 28 (as shown by the solid line), whereupon the hopper 35 is lowered and its lower end portion is inserted into the mouth of the flat bag 1. Subsequently, the material to be packaged (content) is injected into the hopper 35 and then into the bag, so that the bag is filled with the material to be packaged. Thereafter, the hopper 35 is raised, removed from the mouth of the flat bag 1, opened and then retracted to the retracted position. Immediately after that, the gripper pair 3 and the gas injection nozzle 28 start moving towards stop position F. It should be noted that while the gripper pair 3 and the gas injection nozzle 28 are moved from stop position D to stop position E, and they stay at stop position E, the injection of the gas into the bag is carried out in a continuous manner, ensuring gas exchange in the bag.

Gas to be exchanged is continuously injected from the gas injection nozzle 28 while the gripper pair 3 (and therefore flat bag 1 as well) intermittently travels from stop position E to stop position H as well as while it is at stop position H.

At stop position H, the distance between the two grippers 3 is widened, the mouth of the flat bag 1 is thus tensed in the side-to-side direction, the mouth that was opened is closed, and then the gas injection nozzle 28 is raised and withdrawn from the flat bag 1. Subsequently, the distance between the grippers 3 is widened even more, and the mouth of the flat bag 1 is tensed in the side-to-side manner further, thereby completely closing the mouth of the flat bag 1. On the other hand, immediately after withdrawing the gas injection nozzle 28 from the flat bag 1, the injection of the gas is terminated, and the gas injection nozzle 28 stops in the original upper end position.

At stop position I, the mouth of the bag is sealed by a pair of heating plates 36*a*, after which, at stop position J, the sealed mouth is cooled by a pair of cooling plates 37*a*. Subsequently, the gripping portions 3*a* of the gripper pair 3 are opened, and the packaged product (packaged bag 1) is dropped into packaged product discharge chute 38 and discharged from the packaging machine.

When the bags to be filled are irregularly shaped bags (see the irregularly shaped bag 2 in FIG. 4B) in which the location of the center Mc of the mouth of the bag in its width direction is offset from the central location Gc of the gripper pair 3, the packaging steps performed by each packaging apparatus of the above-described rotary-type bag filling and packaging machine are carried out in a manner practically identical to the procedure described above. However, the relative positional relationship between the rotary table 16 and the synchronized table 19 is configured to match the specifications illustrated in FIG. 3, wherein each gas injection nozzle 28 is offset from the central location Gc of each pair of grippers 3 by a distance W when viewed from above. In addition, the raising/lowering operation of the gas injection nozzle 28 is also modified to match the specifications suitable for the packaged product. Furthermore, in the example illustrated in FIG. 3, the size and position of the pair of suction cups 34 of the opening device are modified.

In the above-described rotary-type bag filling and packaging machine, an offset could be produced with respect to the relative positional relationship between the rotary table 16 and the synchronized table 19 as a result of certain problems arising during continuous production of identical packaged products. It is, therefore, preferable to set up a homing mode in the controller 13 as a countermeasure against such a situation. A preferred homing mode can be established, for example, so that when the homing mode is activated by operating the control panel of the controller 13, the packaging members (in the above-described example, the gas injection nozzles 28) of the synchronized-type packaging apparatus are raised to the upper end position, and after that, the previously described initial setup process is carried out automatically, the rotary table 16 as a result stops at the original position, and the synchronized table 19 stops at a reference position that corresponds to the type of the packaged product, thus eliminating the offset in the relative positional relationship between the rotary table 16 and the synchronized table 19.

In the above-described rotary-type bag filling and packaging machine, the relative positional relationship between the rotary table 16 and the synchronized table 19 is modified depending on the packaged products (ordinary flat bag 1 or irregularly shaped bag 2). However, this relative positional relationship is not changed if, for example, only one type of packaged product is to be manufactured in the same rotary-type bag filling and packaging machine, or if a plurality of types of packaged products are to be manufactured but in all the cases the relative positional relationship between the rotary table 16 and the synchronized table 19 may remain the same. In this case that the relative positional relationship between the two tables is not changed, if it is assumed that the relative positional relationship be achieved when the rotary table 16 and the synchronized table 19 are both at the original position, then it is sufficient to ensure that only the steps of returning to the origin position of the rotary table 16 and the synchronized table 19 are carried out among the steps involved in the initial setup process. This is the same for the above-described homing mode as well.

As seen from the above, the specifications of the raising/lowering operations (raising/lowering range, raising/lowering timing, raising/lowering speed, and raising/lowering frequency per injection, etc.) of the gas injection nozzles 28 that correspond to a plurality of different packaged products are inputted in the memory means of the controller 13 in advance and specifying the type of the packaged product during the initial setup makes it possible to direct the gas injection nozzles 28 to perform the raising/lowering operations corresponding to the packaged product, and as a result, a packaged product that has a high degree of perfection can be obtained at all times even if the type of the packaged product is changed. Several examples of the specifications of the raising/lowering operations performed by the gas injection nozzles 28 are described below.

(1) While in the above description the insertion of the gas injection nozzles 28 and the injection of the gas into bags are timed to take place prior to the filling of the bags with the material to be packaged, depending on the type of the packaged product, this timing can be set for after the filling of the bags with the material to be packaged.

(2) If it is desired, for example, that the lower end position Hd (see FIGS. 4A and 4B) of the gas injection nozzle 28 is located in the vicinity of the bottom of a bag to be filled with a particular material to be packaged regardless of the length (or height) of a bag, the lower end position Hd is set to a height that corresponds to the bag length (or bag height).

(3) Depending on the type of the packaged product, the depth for inserting the gas injection nozzle 28 is reduced, so that the lower end position Hd (see FIGS. 4A and 4B) of the gas injection nozzle 28 is located just above the material to be packaged, or alternatively, the depth of insertion is increased, so that the lower end position Hd of the gas injection nozzle 28 is located in the vicinity of the bottom of a bag.

(4) When the gas injection nozzle 28 is raised, its ascent is stopped immediately after the lower end withdraws from the mouth of a bag. This makes it possible that the material to be packaged which can be adhered to the portions of the inner surface of the bag mouth that is intended to be sealed can be blown into the bag by the pressure of the gas jetting out from the gas injection nozzle 28.

Though in the above description the packaging members are gas injection nozzles, liquid filling nozzles can be employed instead; and also the rotary table and the synchronized table can be provided so as to rotate continuously in addition to rotating intermittently in one direction.

The invention claimed is:

1. A rotary-type bag filling and packaging machine wherein said filling and packaging machine comprises:

a rotary table rotating in one direction on a horizontal plane, and a plurality of gripper pairs provided on a periphery of said rotary table at regular intervals, said gripper pairs for clamping two side edge portions of a supplied bag and holding the bag in a suspended position;

said gripper pairs travel in a rotational manner in one direction, and packaging operations including opening a mouth of the bag, filling the bag with material to be packaged, and sealing the mouth of the bag are performed in a sequential manner; and a packaging apparatus performing a specific packaging operation among said packaging operations includes a plurality of packaging members which are provided in conjunction with each pair of grippers, travel in a rotational manner in synchronism with said gripper pairs, and are raised and lowered at a predetermined timing; and wherein said rotary-type bag filling and packaging machine further comprises:

a synchronized table provided above said rotary table in co-axial therewith and provided thereon with a plurality of said packaging members disposed at regular intervals;

a first servo motor for rotating said synchronized table;

a second servo motor provided on said synchronized table in conjunction with each of said packaging members for raising or lowering said packaging member; and a controller for controlling a drive source of said rotary table and driving of said first and second servo motors so as to rotate the synchronized table in synchronism with said rotary table and raise or lower said packaging members at a predetermined timing.

2. The rotary-type bag filling and packaging machine according to claim 1, wherein a sensor is provided for detecting a relative positional relationship in a direction of rotation between a fixed location of said rotary table and a fixed location of said synchronized table, and said controller adjusts the relative positional relationship between two fixed locations of said tables in a direction of rotation thereof based on a detection signal obtained from the sensor.

3. The rotary-type bag filling and packaging machine according to claim 1, wherein a sensor is provided for detecting a relative positional relationship in a direction of rotation between a fixed location of said rotary table and a fixed location of said synchronized table;

data on a type of packaged product and a corresponding relative positional relationship between said two fixed locations of said tables in a direction of rotation is inputted in said controller in advance; and said controller adjusts the relative positional relationship between said two fixed locations in the direction of rotation based on a detection signal obtained from the sensor and said data in accordance with a type of packaged product.

4. The rotary-type bag filling and packaging machine according to any of claims 1-3, wherein said packaging members are gas injection nozzles or liquid filling nozzles.

5. The rotary-type bag filling and packaging machine according to any of claims 1-3, wherein said rotary table rotates intermittently, and said gripper pairs travel intermittently at said regular intervals.

6. The rotary-type bag filling and packaging machine according to claim 4, wherein said rotary table rotates intermittently, and said gripper pairs travel intermittently at said regular intervals.

* * * * *